US011572241B2

(12) United States Patent
Kurita

(10) Patent No.: US 11,572,241 B2
(45) Date of Patent: Feb. 7, 2023

(54) SHEET CONVEYING DEVICE AND IMAGE PROCESSING APPARATUS

(71) Applicant: TOSHIBA TEC KABUSHIKI KAISHA, Tokyo (JP)

(72) Inventor: Eizo Kurita, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 158 days.

(21) Appl. No.: 17/128,359

(22) Filed: Dec. 21, 2020

(65) Prior Publication Data

US 2021/0362972 A1 Nov. 25, 2021

(30) Foreign Application Priority Data

May 20, 2020 (JP) ..... JP2020-088065

(51) Int. Cl.

| | |
|---|---|
| ***B65H 5/06*** | (2006.01) |
| ***B65H 29/12*** | (2006.01) |
| ***B65H 7/02*** | (2006.01) |
| ***B65H 15/00*** | (2006.01) |
| *G03G 15/23* | (2006.01) |

(52) U.S. Cl.

CPC ..... *B65H 7/02* (2013.01); *B65H 15/004* (2020.08); *B65H 29/125* (2013.01); *B65H 2515/32* (2013.01); *G03G 15/234* (2013.01)

(58) Field of Classification Search

CPC ..... B65H 5/062; B65H 5/06; B65H 29/125; B65H 29/12; B65H 85/00; B65H 7/02; B65H 15/004; B65H 2403/724; B65H 2403/732; G03G 15/234

See application file for complete search history.

(56) References Cited

U.S. PATENT DOCUMENTS

2013/0187330 A1* 7/2013 Kuroda ..... B41J 13/0045 271/225

FOREIGN PATENT DOCUMENTS

| | | | |
|---|---|---|---|
| JP | 64-40547 | | 3/1989 |
| JP | 03-142475 | | 6/1991 |
| JP | 2002274691 A | * | 9/2002 |
| JP | 2008-023884 | | 2/2008 |
| JP | 2010269861 A | * | 12/2010 |

* cited by examiner

*Primary Examiner* — Luis A Gonzalez

(74) *Attorney, Agent, or Firm* — Amin, Turocy & Watson, LLP

(57) ABSTRACT

According to one embodiment, a sheet conveying device includes a roller, a motor, a clutch, and a torque generator. The roller conveys a sheet. The motor is a driving source. The clutch connects or disconnects drive of the motor with respect to the roller. The torque generator applies a torque to the roller.

20 Claims, 6 Drawing Sheets

SHEET CONVEYING DEVICE AND IMAGE PROCESSING APPARATUS

CROSS-REFERENCE TO RELATED APPLICATION

This application is based upon and claims the benefit of priority from Japanese Patent Application No. 2020-088065, filed on May 20, 2020, the entire contents of which are incorporated herein by reference.

FIELD

Embodiments described herein relate generally to a sheet conveying device and an image processing apparatus.

BACKGROUND

An image processing apparatus includes an automatic duplex copy unit (hereinafter referred to as "ADU"). In order to perform image processing on both front and back sides of the sheet, the ADU reverses the front and back of the sheet. The ADU includes a sheet conveying device that conveys a sheet. The sheet conveying device includes a roller, a motor, and a clutch. The clutch connects or disconnects drive of the motor with respect to the roller. The sheet conveying device controls the conveying of the sheet by connecting and disconnecting the clutch. Depending on the specifications of the idling torque of the clutch, there is a possibility that the time (hereinafter referred to as "roller stop time") until the roller stops rotating if the clutch is disconnected extends, and the variation in the roller stop time increases.

DETAILED DESCRIPTION

A concern addressed by an exemplary embodiment is to provide a sheet conveying device and a document reading device capable of shortening the roller stop time if the clutch is disconnected and reducing the variation in the roller stop time.

A sheet conveying device of an exemplary embodiment includes a roller, a motor, a clutch, and a torque generator. The roller conveys a sheet. The motor is a driving source. The clutch connects or disconnects drive of the motor with respect to the roller. The torque generator applies a torque to the roller.

Hereinafter, a sheet conveying device and an image processing apparatus according to an embodiment will be described with reference to the drawings.

First, a first embodiment will be described with reference to FIGS. 1 to 5.

Figure 1:
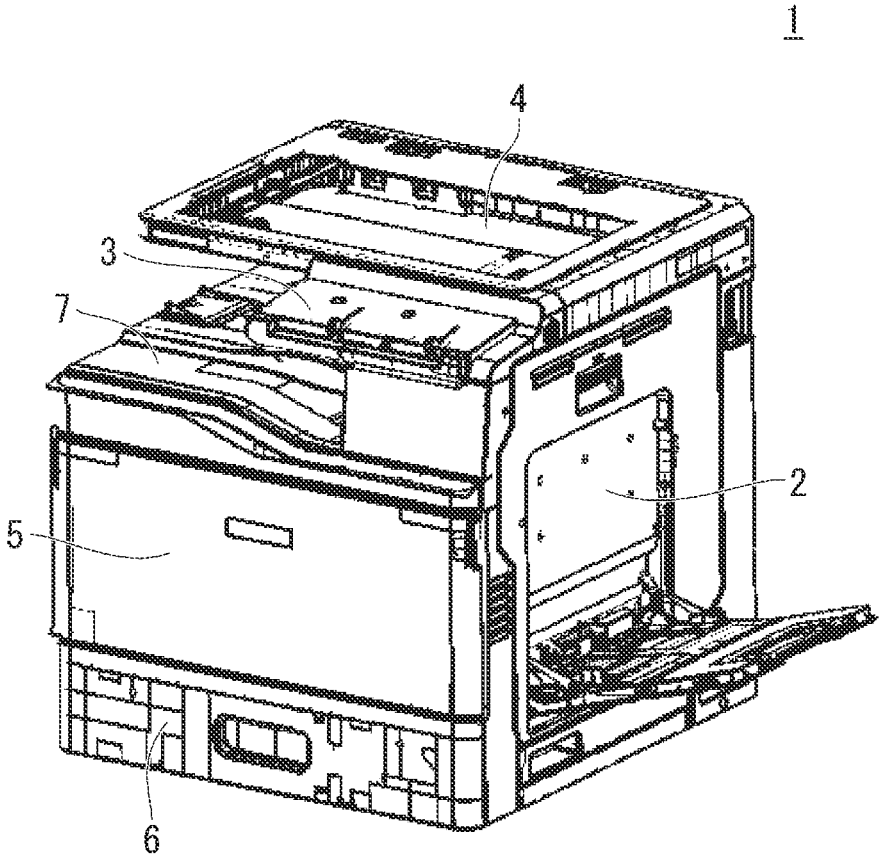
FIG. 1 is a perspective view of an image processing apparatus according to a first embodiment.

FIG. 1 is a perspective view of an image processing apparatus 1 according to the first embodiment.

For example, the image processing apparatus 1 is a multi-function peripheral (MFP). The image processing apparatus 1 reads an image formed on a sheet-like recording medium (hereinafter referred to as "sheet") such as a paper sheet to generate digital data (image file). The image processing apparatus 1 forms an image on a sheet using a toner based on the digital data.

The image processing apparatus 1 includes an ADU 2, a display unit 3, an image reading unit 4, an image forming unit 5, and a sheet tray 6.

The ADU 2 is an automatic double-sided copy unit. The ADU 2 is provided on the side portion of a main body of the image processing apparatus 1. The ADU 2 reverses the front and back of the sheet. For example, the front and back reversal of the sheet is performed if an image is formed on both the front and back sides of the sheet.

The display unit 3 operates as an output interface and displays characters or images. The display unit 3 also operates as an input interface and receives instructions from the user. For example, the display unit 3 is a touch panel type liquid crystal display.

For example, the image reading unit 4 is a color scanner. Color scanners include a contact image sensor (CIS) and a charge coupled device (CCD). The image reading unit 4 uses a sensor to read an image formed on the sheet and generate the digital data.

The image forming unit 5 forms an image on the sheet using a toner. The image forming unit 5 forms an image based on the image data read by the image reading unit 4 or the image data received from external equipment. For example, the image formed on the sheet is an output image called a hard copy, a printout, or the like.

The sheet tray 6 supplies a sheet to be used for image output to the image forming unit 5.

Figure 2:
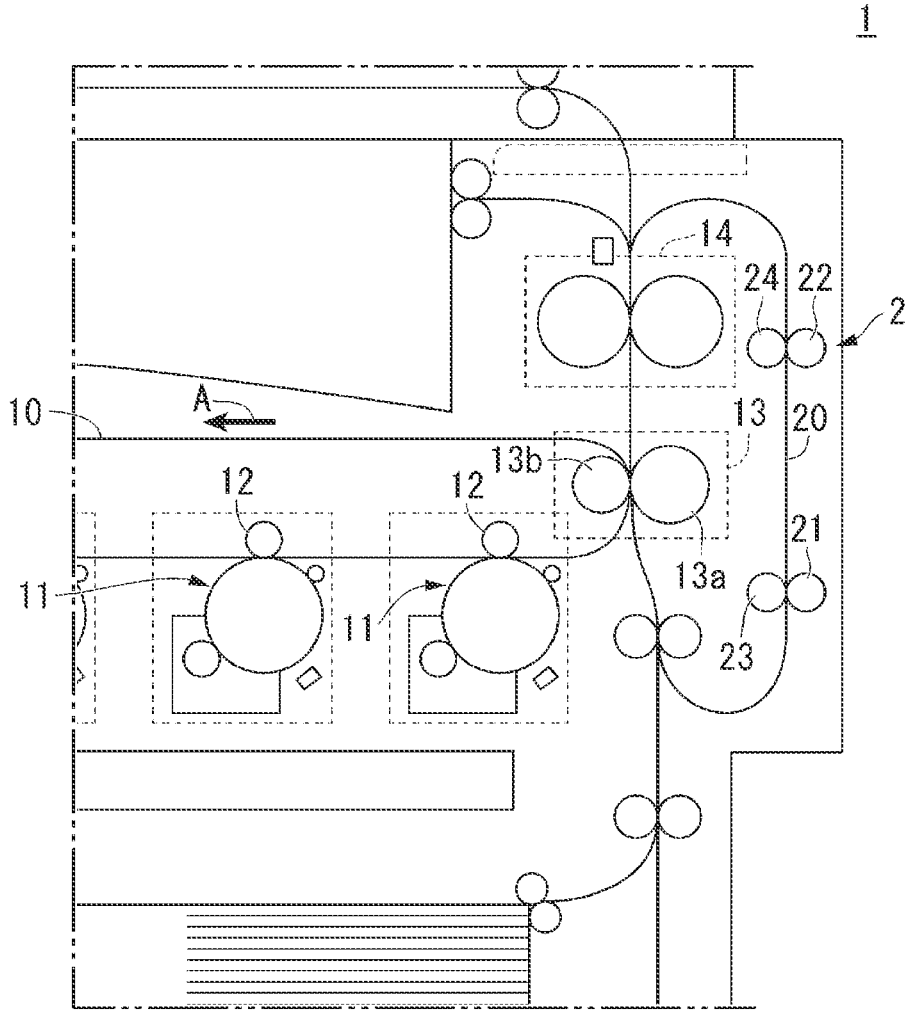
FIG. 2 is a sectional view illustrating an internal configuration.

FIG. 2 is a sectional view illustrating an internal configuration of the image processing apparatus 1 according to the first embodiment. In FIG. 2, the face hatch is omitted.

As illustrated in FIG. 2, the image processing apparatus 1 includes an intermediate transfer body 10, an image forming unit 11, a primary transfer roller 12, a secondary transfer unit 13, and a fixing device 14.

A transfer in the image processing apparatus 1 includes a first transfer step and a second transfer step. In the first transfer step, the primary transfer roller 12 transfers an image (toner image) by a toner on a photoreceptor drum of each image forming unit to the intermediate transfer body 10. In the second transfer step, the secondary transfer unit 13 transfers the image to the sheet with the toner of each color laminated on the intermediate transfer body 10.

The intermediate transfer body 10 is an endless belt. The intermediate transfer body 10 is rotating in the direction of an arrow A in FIG. 2. An image of toner is formed on the surface of the intermediate transfer body 10.

The image forming unit 11 forms an image using a toner of each color (for example, five colors). A plurality of image forming units 11 are installed along the intermediate transfer body 10. FIG. 2 illustrates a part of the plurality of image forming units 11.

The primary transfer roller 12 transfers the toner image formed by the image forming unit 11 to the intermediate transfer body 10.

The secondary transfer unit 13 includes a secondary transfer roller 13*a* and a secondary transfer counter roller 13*b*. The secondary transfer unit 13 transfers the toner image formed on the intermediate transfer body 10 to the sheet.

The fixing device 14 fixes the toner image transferred onto the sheet to the sheet by heating and pressurizing. The sheet on which the image is formed by the fixing device 14 is discharged to the outside of the apparatus from a paper discharge unit 7 (refer to FIG. 1).

Next, the ADU 2 will be described.

As illustrated in FIG. 2, the ADU 2 is disposed on the side of the fixing device 14. The ADU 2 has a reversion path 20 for reversing the front and back of the sheet and conveying the sheet to the next step. The ADU 2 includes a plurality (for example, four) of reversing rollers 21 to 24 that form the reversion path 20. The plurality of reversing rollers 21 to 24 are a first roller 21, a second roller 22, a third roller 23, and a fourth roller 24.

Figure 3:
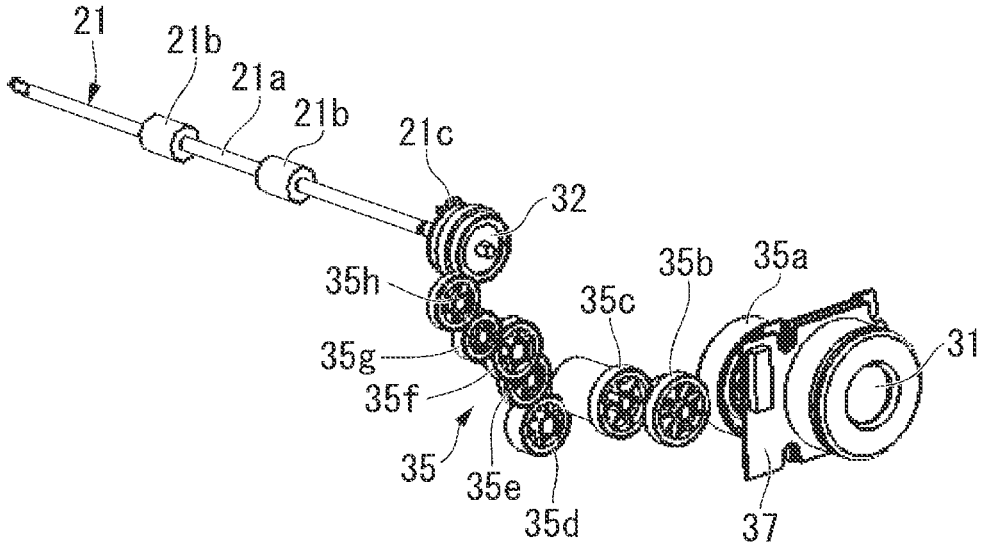
FIG. 3 is a perspective view illustrating a drive configuration of a first roller.

The first roller 21 is a driving roller that rotates by being driven by a motor 31 (refer to FIG. 3). The first roller is capable of performing forward rotation (clockwise rotation) and reverse rotation (counterclockwise rotation).

The second roller 22 is disposed above the first roller 21. The second roller 22 is a driven roller that rotates according to the rotation of the first roller 21 via a timing belt 34 (refer to FIG. 4) or the like.

The third roller 23 opposes the first roller 21. The third roller 23 is a driven roller that rotates according to the rotation of the first roller 21.

The fourth roller 24 opposes the second roller 22. The fourth roller 24 is a driven roller that rotates according to the rotation of the second roller 22.

Next, a sheet conveying device 30 will be described.

Figure 4:
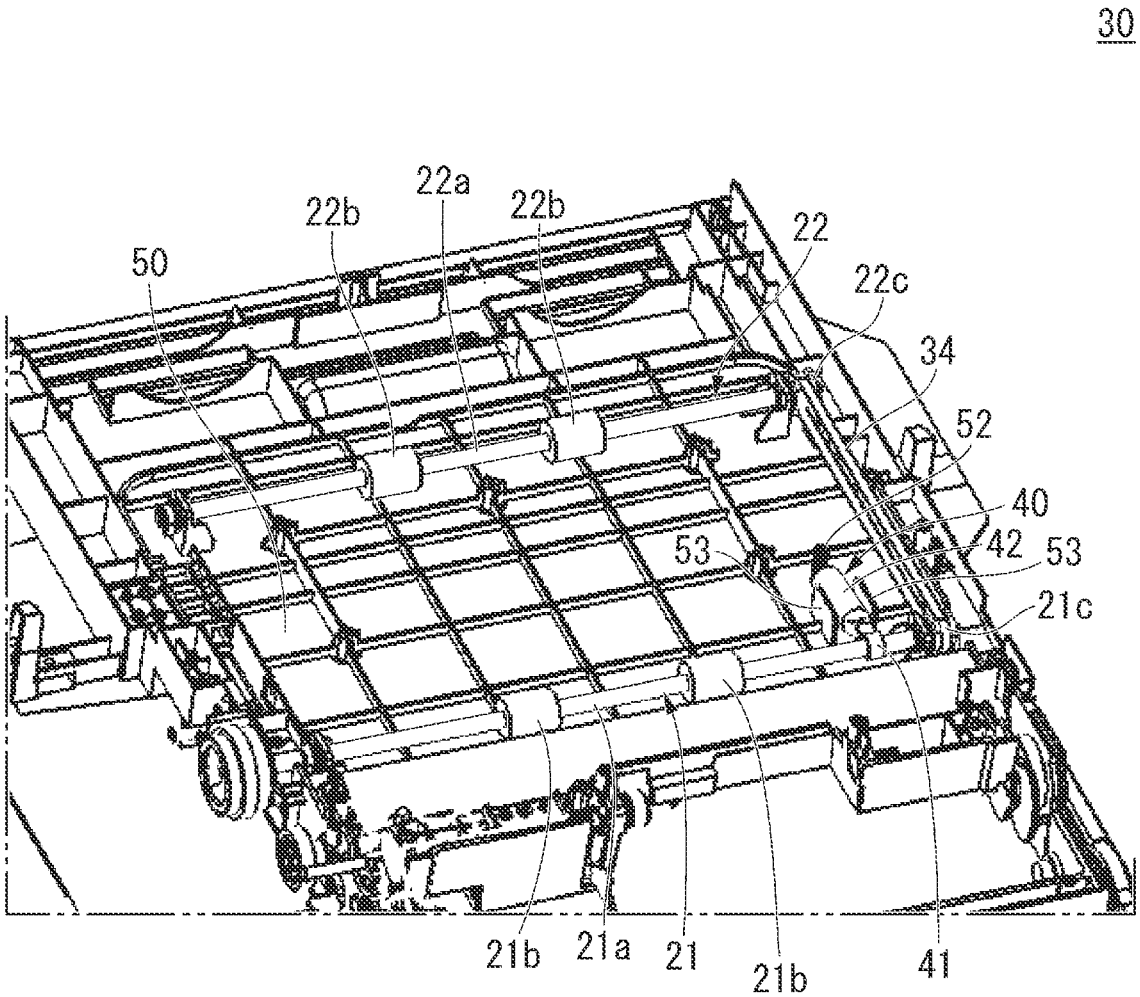
FIG. 4 is a perspective view of a sheet conveying device.

FIG. 4 is a perspective view of the sheet conveying device 30 according to the first embodiment.

The ADU 2 includes the sheet conveying device 30. As illustrated in FIG. 4, the sheet conveying device 30 includes the first roller 21, the second roller 22, the motor 31 (refer to FIG. 3), a clutch 32 (refer to FIG. 3), and a torque generator 40. Each element of the sheet conveying device 30 is disposed on the side of a base 50 that configures the main body.

The first roller 21 is a roller (driving roller) that conveys the sheet. The first roller 21 includes a first shaft 21*a*, a first rotation body 21*b*, and a first pulley 21*c*.

The first shaft 21*a* has a columnar shape that extends in a sheet width direction. Here, the sheet width direction means a direction (paper surface depth direction in FIG. 2) orthogonal to the sheet conveying direction. For example, the first shaft 21*a* is made of metal.

The first rotation body 21*b* has a cylindrical shape coaxial with the first shaft 21*a*. The first rotation body 21*b* has an outer diameter larger than that of the first shaft 21*a*. A pair of first rotation bodies 21*b* are provided at the center of the first shaft 21*a* in the shaft direction at an interval.

The first pulley 21*c* has a disk shape coaxial with the first shaft 21*a*. The first pulley 21*c* is attached to one end portion of the first shaft 21*a*.

The second roller 22 is separated from the first roller 21 in the sheet conveying direction. The second roller 22 is a driven roller that rotates according to the rotation of the first roller 21. The second roller 22 includes a second shaft 22*a*, a second rotation body 22*b*, and a second pulley 22*c*.

The second shaft 22*a* has a columnar shape that extends in parallel to the first shaft 21*a*. For example, the second shaft 22*a* is made of metal.

The second rotation body 22*b* has a cylindrical shape coaxial with the second shaft 22*a*. The second rotation body 22*b* has an outer diameter larger than that of the second shaft 22*a*. A pair of second rotation bodies 22*b* are provided at the center of the second shaft 22*a* in the shaft direction at an interval.

The second pulley 22*c* has a disk shape coaxial with the second shaft 22*a*. The second pulley 22*c* is attached to one end portion of the second shaft 22*a*.

The timing belt 34 is bridged over the first pulley 21*c* and the second pulley 22*c*. The timing belt 34 is an endless belt. The rotation of the first roller 21 is transmitted to the second roller 22 through the first pulley 21*c*, the timing belt 34, and the second pulley 22*c*.

The motor 31 is a driving source of the first roller 21 (refer to FIG. 3). For example, the motor 31 is shared as a motor of a developing device (not illustrated). As illustrated in FIG. 3, the motor 31 is attached to a main body of the device via a support member 37 or the like.

The clutch 32 connects or disconnects the drive of the motor 31 with respect to the first roller 21. For example, the clutch 32 is an electromagnetic clutch. In the connected state (the excited state of the electromagnetic clutch) of the clutch 32, the drive of the motor 31 is transmitted to the first roller 21. Meanwhile, in the disconnected state (the non-excited state of the electromagnetic clutch) of the clutch 32, the drive of the motor 31 is not transmitted to the first roller 21. The sheet conveying device 30 controls the rotation of the first roller 21 by connecting and disconnecting the clutch 32.

As illustrated in FIG. 3, a gear train 35 is provided between the motor 31 and the clutch 32. The gear train 35 includes a plurality (for example, eight) of gears 35*a* to 35*h*. The plurality of gears 35*a* to 35*h* are the first gear 35*a*, the second gear 35*b*, the third gear 35*c*, the fourth gear 35*d*, the fifth gear 35*e*, the sixth gear 35*f*, the seventh gear 35*g*, and the eighth gear 35*h*. The first gear 35*a* has the largest outer diameter among the plurality of gears 35*a* to 35*h*. The first gear 35*a* to the eighth gear 35*h* mesh with each other in this order from the motor 31 toward the clutch 32. In the connected state of the clutch 32, the drive of the motor 31 is transmitted to the first roller 21 via the gear train 35 and the clutch 32.

The drive of the motor 31 may be transmitted to the first roller 21 via a power transmission mechanism other than the gear train such as a belt and a pulley. For example, an aspect of the power transmission mechanism can adopt various configurations according to the required specifications.

Next, the torque generator 40 will be described.

Figure 5:
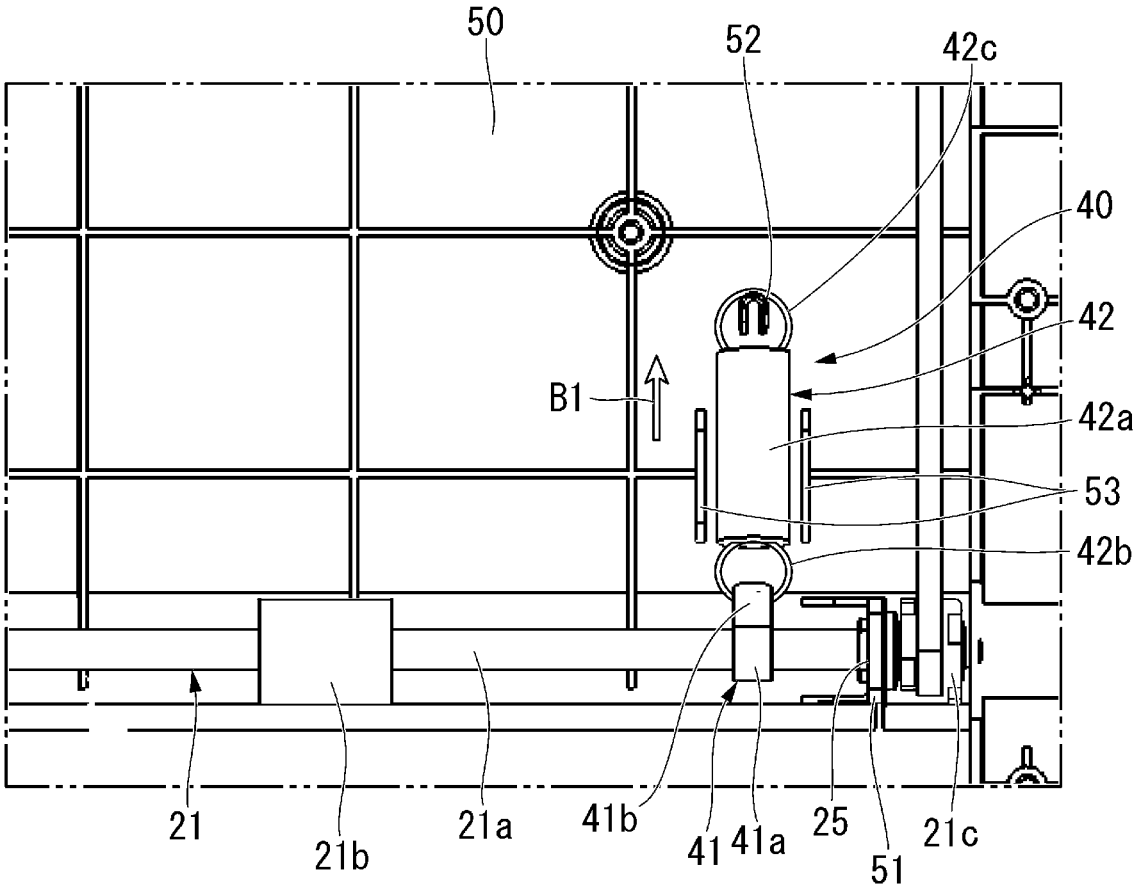
FIG. 5 is an enlarged peripheral view of a torque generator.

FIG. 5 is an enlarged peripheral view of the torque generator 40 according to the first embodiment.

The torque generator 40 applies a torque to the first roller 21. As illustrated in FIG. 5, the torque generator 40 is disposed in the vicinity of a bearing 25 of the first roller 21. The bearing 25 of the first roller 21 has an annular shape coaxial with the first shaft 21*a*. For example, the bearing 25 is made of a resin such as polyacetal (POM). The bearing 25 is attached to a support wall portion 51 that projects laterally from the base 50. The first shaft 21*a* is rotatably supported by the support wall portion 51 via the bearing 25.

The torque generator 40 includes a sliding member 41 and a bias generator 42.

The sliding member 41 is slidable with respect to the first roller 21. For example, the sliding member 41 is made of a resin such as polyacetal (POM). For example, the sliding member 41 is preferably made of a material that can smoothly slide with respect to the first shaft 21*a*. The sliding member 41 is disposed between the first rotation body 21*b* and the bearing 25 in the shaft direction of the first shaft 21*a*. The sliding member 41 is disposed closer to the bearing 25 than the first rotation body 21*b*.

The sliding member 41 includes an annular portion 41*a* and a bulging portion 41*b*.

The annular portion 41*a* has an annular shape coaxial with the first shaft 21*a*. The annular portion 41*a* has a hole where the first shaft 21*a* extends through. The hole may generate a friction force with the first shaft 21*a*. The friction force effects as braking force. The annular portion 41*a* may have a hook shape, instead of the hole, to engage with the first shaft 21*a*. The annular portion 41*a* may have a shape to pinch the first shaft 21*a*. The annular portion 41*a* may have a shape to grab the first shaft 21*a*.

The bulging portion 41*b* bulges outward in the radial direction from a part of the annular portion 41*a*. The bulging portion 41*b* has a shape to which one end (first hook 42*b*) of the bias generator 42 can be attached.

The annular portion 41*a* and the bulging portion 41*b* are integrally formed of the same member.

For example, the bias generator 42 is a tension coil spring. The bias generator 42 biases the sliding member 41 in the direction of an arrow B1. The bias generator 42 always biases in the direction of pulling the sliding member 41. The bias generator 42 includes a spring 42*a*, the first hook 42*b*, and a second hook 42*c*.

The spring 42*a* is extensiblely disposed in a direction (the direction of the arrow B1) orthogonal to the first shaft 21*a*.

The first hook 42*b* is provided at the first end of the spring 42*a*. The first hook 42*b* is attached to the bulging portion 41*b* of the sliding member 41.

The second hook 42*c* is provided at the second end of the spring 42*a*. The second hook 42*c* is attached to a claw portion 52 that projects laterally from the base 50.

Reference numeral 53 in the drawing indicates a regulation wall portion provided on the base 50 for regulating the position (movement in the direction parallel to the first shaft 21*a*) of the spring 42*a*. A pair of regulation wall portions 53 is provided with the spring 42*a* therebetween.

The first hook 42*b* of the bias generator 42 is detachably attached to the bulging portion 41*b* of the sliding member 41. The second hook 42*c* of the bias generator 42 is detachably attached to the claw portion 52 of the base 50. The torque generator 40 can adjust (change) the torque with respect to the first roller 21 by replacing the bias generator 42.

For example, if the torque on the first roller 21 is maintained before and after the replacement of the bias generator 42, the bias generator is replaced with a bias generator having the same biasing force as that before the replacement.

For example, if the torque on the first roller 21 is made larger than that before the replacement of the bias generator 42, the bias generator is replaced with a bias generator having a larger biasing force than that before the replacement.

For example, if the torque on the first roller 21 is made smaller than that before the replacement of the bias generator 42, the bias generator is replaced with a bias generator having a smaller biasing force than that before the replacement.

As described above, the sheet conveying device 30 according to the embodiment includes the first roller 21, the motor 31, the clutch 32, and the torque generator 40. The first roller 21 conveys the sheet. The motor 31 is a driving source. The clutch 32 connects or disconnects the drive of the motor 31 with respect to the first roller 21. The torque generator 40 applies a torque to the first roller 21. With the above configuration, the following effects are obtained.

Since the torque generator 40 applies a torque to the first roller 21, the first roller 21 can be made to stop rotating if the clutch 32 is disconnected. In other words, even if the torque of the first roller 21 is light according to the specification of the idling torque of the clutch 32, a torque (braking force) for stopping the rotation of the first roller 21 is applied by the action of the torque generator 40. Therefore, it is possible to suppress an increase in time (roller stop time) until the rotation of the first roller 21 is stopped if the clutch 32 is disconnected. Therefore, the roller stop time if the clutch 32 is disconnected can be shortened, and the variation in the roller stop time can be reduced.

The torque generator 40 achieves the following effects by being disposed in the vicinity of the bearing 25 of the first roller 21.

Compared with a case where the torque generator 40 is disposed at a position far away from the bearing 25 of the first roller 21, it is easy to apply a constant torque to the first roller 21. Therefore, the variation in the roller stop time if the clutch 32 is disconnected can be further reduced.

The torque generator 40 includes the sliding member 41 that can slide with respect to the first roller 21, and the bias generator 42 that biases the sliding member 41. With the above configuration, the following effects are obtained.

Since a torque is applied to the first roller 21 via the sliding member 41, the rotation of the first roller 21 can be maintained in the connected state of the clutch 32, and the rotation of the first roller 21 can be made to stop rotating if the clutch 32 is disconnected. Therefore, it is possible to control the conveying of the sheet by connecting and disconnecting the clutch 32 with high accuracy. In addition, the configuration can be simplified as compared with a case where a driving device such as an actuator is provided as the torque generator 40.

The torque generator 40 achieves the following effects by being capable of adjusting the torque on the first roller 21 by replacing the bias generator 42.

By replacing the bias generator 42, a desired torque can be applied to the first roller 21. For example, if the member is replaced with a bias generator having a larger biasing force, the roller stop time if the clutch 32 is disconnected can be shortened more effectively, and the variation in the roller stop time can be reduced.

The image processing apparatus 1 includes the above-described sheet conveying device 30.

The sheet conveying device 30 can shorten the roller stop time if the clutch 32 is disconnected, and reduce the variation in the roller stop time. Therefore, the image processing apparatus 1 can smoothly perform image processing on both the front and back sides of the sheet.

Next, a second embodiment will be described with reference to FIG. 6. In the second embodiment, the description of the same configurations as those of the first embodiment will be omitted.

The bias generator 42 is not limited to biasing only the sliding member 41 that slides the first roller 21. The second embodiment is different from the first embodiment in that the bias generator 42 biases each of the sliding members 41 and 241 that slide the first roller 21 and the second roller 22.

Figure 6:
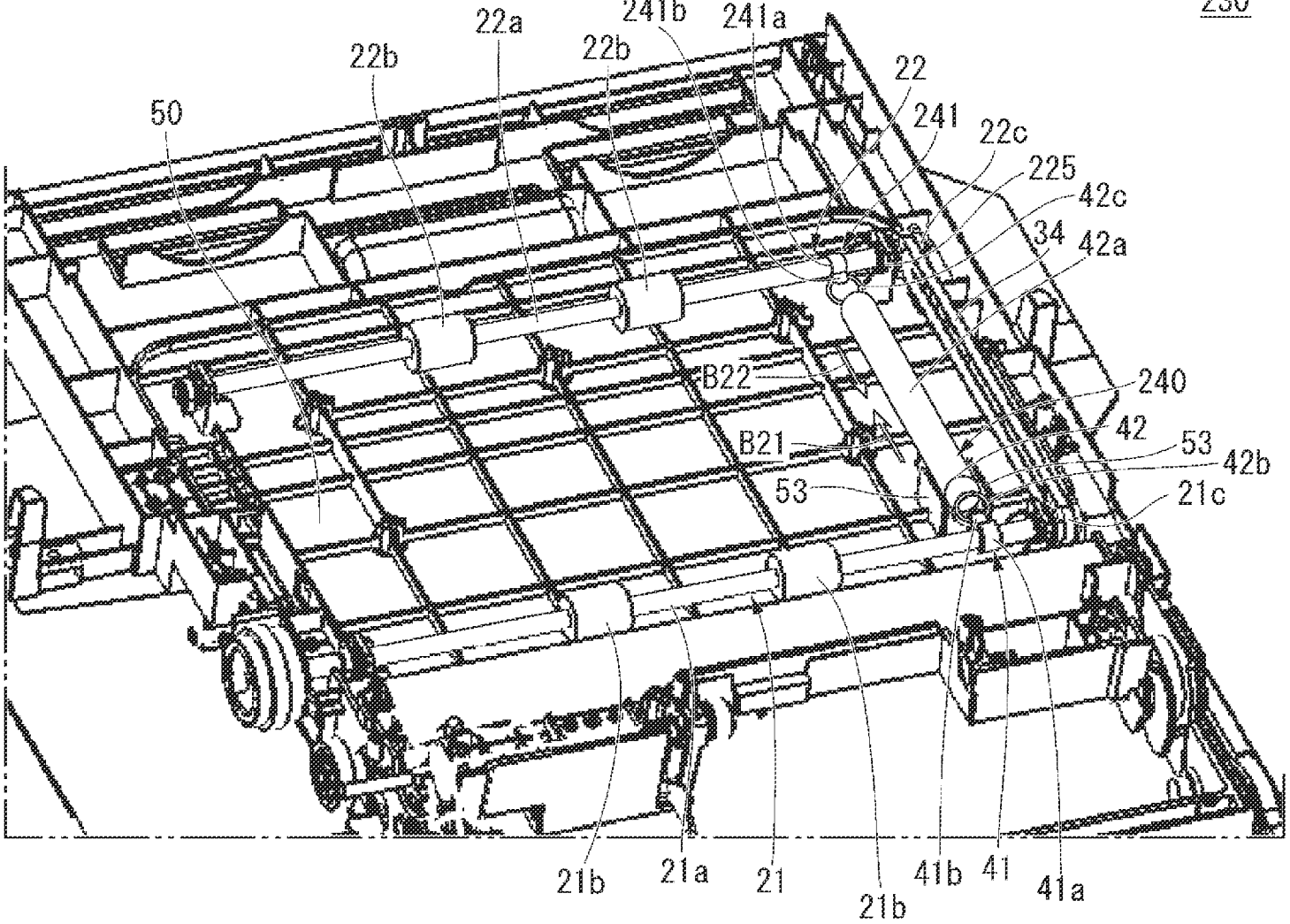
FIG. 6 is a perspective view of a sheet conveying device according to a second embodiment.

FIG. 6 is a perspective view of a sheet conveying device 230 according to the second embodiment.

As illustrated in FIG. 6, the sheet conveying device 230 includes a torque generator 240 that applies a torque to each of the first roller 21 and the second roller 22.

The torque generator 240 includes the plurality of sliding members 41 and 241 and the bias generator 42.

The plurality of sliding members 41 and 241 are the sliding member 41 (hereinafter referred to as "first sliding member 41") slidable with respect to the first roller 21 and the second sliding member 241 slidable with respect to the second roller 22. For example, each of the sliding members 41 and 241 is made of a resin such as polyacetal (POM).

The second sliding member 241 is disposed between the second rotation body 22*b* and a bearing 225 (hereinafter referred to as "second bearing 225") in the shaft direction of the second shaft 22*a*. The second sliding member 241 is disposed closer to the second bearing 225 than the second rotation body 22*b*.

The second sliding member 241 includes a second annular portion 241*a* and a second bulging portion 241*b*.

The second annular portion 241*a* has an annular shape coaxial with the second shaft 22*a*.

The second bulging portion 241*b* bulges outward in the radial direction from a part of the second annular portion 241*a*. The second bulging portion 241*b* has a shape to which the other end (second hook 42*c*) of the bias generator 42 can be attached.

The second annular portion 241*a* and the second bulging portion 241*b* are integrally formed of the same member.

The bias generator 42 is bridged between the first sliding member 41 and the second sliding member 241.

The bias generator 42 biases the first sliding member 41 in the direction of an arrow B21. The bias generator 42 biases the second sliding member 241 in the direction of an arrow B22.

The first hook 42*b* of the bias generator 42 is attached to the bulging portion 41*b* of the first sliding member 41. The second hook 42*c* is attached to the second bulging portion 241*b*.

According to the second embodiment, the plurality of sliding members 41 and 241 are provided. The plurality of sliding members 41 and 241 are the first sliding member 41 slidable with respect to the first roller 21 and the second sliding member 241 slidable with respect to the second roller 22. The bias generator 42 is bridged between the first sliding member 41 and the second sliding member 241. With the above configuration, the following effects are obtained.

Since the torque generator 240 applies a torque to each of the first roller 21 and the second roller 22, each of the first roller 21 and the second roller 22 can be made to stop rotating if the clutch 32 is disconnected. Therefore, the roller stop time if the clutch 32 is disconnected can be shortened more effectively, and the variation in the roller stop time can be reduced. [ 0047] Next, a third embodiment will be described with reference to FIG. 7. In the third embodiment, the description of the same configurations as those of the first embodiment will be omitted.

The second hook 42*c* of the bias generator 42 is not limited to being attached to the claw portion 52 of the base 50. The third embodiment is different from the first embodiment in that the second hook 42*c* is attached to a load adjustor 341.

Figure 7:
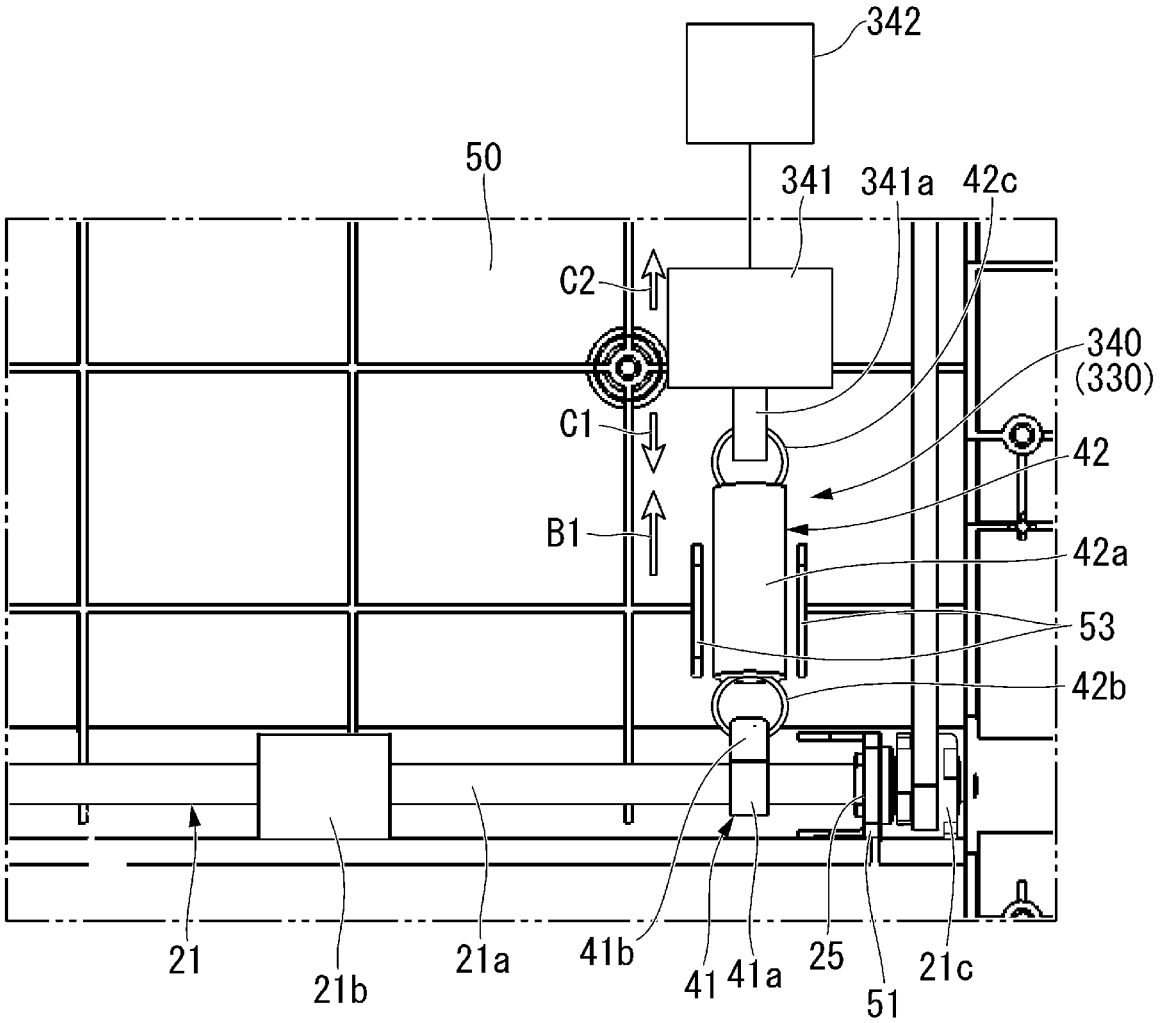
FIG. 7 is an enlarged peripheral view of a torque generator according to a third embodiment.

FIG. 7 is an enlarged peripheral view of a torque generator 340 according to the third embodiment.

As illustrated in FIG. 7, the torque generator 340 includes the load adjustor 341 and a load control device 342 in addition to the sliding member 41 and the bias generator 42.

The load adjustor 341 can adjust the load on the first roller 21. For example, the load adjustor 341 is an actuator such as a solenoid. The load adjustor 341 includes a hook support unit 341*a* that supports the second hook 42*c*. The load adjustor 341 can move the hook support unit 341*a* in the direction (the direction of an arrow C1 or the direction of an arrow C2) orthogonal to the first shaft 21*a*.

The load adjustor 341 moves the hook support unit 341*a* in the direction of the arrow C1 if the load on the first roller 21 is made smaller than the reference load. In other words, the hook support unit 341*a* is brought closer to the first shaft 21*a*.

The load adjustor 341 moves the hook support unit 341*a* in the direction of the arrow C2 if the load on the first roller 21 is made larger than the reference load. In other words, the hook support unit 341*a* is brought further from the first shaft 21*a*.

The load control device 342 is a software functional unit that functions if a predetermined program is executed by a processor such as a central processing unit (CPU). The software functional unit includes a processor such as a CPU, a read only memory (ROM) for storing a program, a random access memory (RAM) for temporarily storing data, and the like. Further, at least a part of the load control device 342 may be an integrated circuit such as a large scale integration (LSI).

The load control device 342 controls the load adjustor 341 so as to adjust the load on the first roller 21 based on the total number (hereinafter referred to as "the number of conveyed sheets") of sheets to be conveyed by a sheet conveying device 330. The load control device 342 stores the life data acquired by a durability test of the bias generator 42 or the like performed in advance. For example, the life data is data of a biasing force (spring force of the spring 42*a*) distribution map acquired by a predetermined number of conveyed sheets.

The biasing force of the bias generator 42 tends to decrease as the number of conveyed sheets increases. Therefore, in order to keep the load on the first roller 21 constant, it is necessary to control the load adjustor 341 so that the biasing force increases as the number of conveyed sheets increases. In the present embodiment, the load control device 342 controls the load adjustor 341 so as to make the hook support unit 341*a* far from the first shaft 21*a* for each predetermined number of conveyed sheets. For example, the load control device 342 controls the load adjustor 341 so as to make the hook support unit 341*a* far from the first shaft 21*a* for each of 300K conveyed sheets.

According to the third embodiment, the sheet conveying device 330 achieves the following effects by including the load adjustor 341 that can adjust the load on the first roller 21.

A desired load can be applied to the first roller 21. For example, if the load on the first roller 21 is made smaller than the reference load, the life of the bias generator 42 can be extended. Meanwhile, if the load on the first roller 21 is made larger than the reference load, the roller stop time if the clutch 32 is disconnected can be shortened more effectively, and the variation in the roller stop time can be reduced.

The sheet conveying device 330 achieves the following effects by including the load control device 342 that controls the load adjustor 341 so as to adjust the load on the first roller 21 based on the number of conveyed sheets.

By controlling the load control device 342, the optimum load can be automatically applied to the first roller 21.

Next, a modification example of the embodiment will be described.

The torque generator 40 of the embodiment is disposed in the vicinity of the bearing 25 of the first roller 21. On the other hand, the torque generator 40 may be disposed at a position far away from the bearing 25 of the first roller 21. For example, the torque generator 40 may be disposed closer to the end portion on the side opposite to the bearing 25 of the first roller 21 in the shaft direction of the first shaft 21*a*. For example, the torque generator 40 may be disposed between a pair of first rotation bodies 21*b*.

The bias generator 42 of the embodiment is a tension coil spring. On the other hand, the bias generator 42 may be a compressive coil spring. For example, the bias generator 42 may not have the first hook 42*b* and the second hook 42*c*. For example, the bias generator 42 may bias the sliding member 41 in a direction opposite to the direction of the arrow B1. In other words, the bias generator 42 may always bias in the direction of pushing the sliding member 41.

The image processing apparatus 1 according to the embodiment is an image forming apparatus. On the other hand, the image processing apparatus may be a decoloring device. In this case, the fixing device may be a decoloring device. The decoloring device performs a process of decoloring (erasing) an image formed on a sheet with a decolorable toner.

According to at least one of the above-described embodiments, since the torque generator applies a load to the roller, the roller can be made to stop rotating if the clutch is disconnected. Therefore, the roller stop time if the clutch is disconnected can be shortened, and the variation in the roller stop time can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet conveying device, comprising:
a roller configured to convey a sheet;
a motor configured to drive the roller;
a clutch configured to connect or disconnect a drive of the motor with respect to the roller;
a torque generator configured to apply a torque against the roller, wherein the torque generator comprises:
a sliding member that is slidable with respect to the roller, and
a bias generator that biases the sliding member; and
a driven roller configured to be separated from the roller in a sheet conveying direction and rotate according to a rotation of the roller, wherein
a plurality of sliding members is provided in the torque generator,
the plurality of sliding members comprises
a first sliding member that is slidable with respect to the roller, and
a second sliding member that is slidable with respect to the driven roller, and
the bias generator bridges between the first sliding member and the second sliding member.

2. The sheet conveying device according to claim 1, wherein
the roller rotates around a shaft, and
the torque generator is disposed on the shaft.

3. The sheet conveying device according to claim 1, wherein
the torque generator is configured to adjust the torque.

4. The sheet conveying device according to claim 1, wherein
the clutch is an electromagnetic clutch.

5. The sheet conveying device according to claim 1, wherein
the torque generator is configured to apply a substantially constant torque to the roller during conveyance of the sheet.

6. The sheet conveying device according to claim 1, wherein
the torque generator is disposed closer to a bearing of the roller than to an end portion of the roller opposite to the bearing.

7. An image processing apparatus, comprising:
an image forming component;
an automatic double-sided copy component; and
a sheet conveying device comprising:
a roller configured to convey a sheet;
a motor configured to drive the roller;
a clutch configured to connect or disconnect a drive of the motor with respect to the roller;
a torque generator configured to apply a torque to the roller, wherein the torque generator comprises:
a sliding member that is slidable with respect to the roller, and
a bias generator that biases the sliding member; and
a driven roller configured to be separated from the roller in a sheet conveying direction and rotate according to a rotation of the roller, wherein
a plurality of sliding members is provided in the torque generator,
the plurality of sliding members comprises
a first sliding member that is slidable with respect to the roller, and
a second sliding member that is slidable with respect to the driven roller, and
the bias generator bridges between the first sliding member and the second sliding member.

8. The image processing apparatus according to claim 7, wherein
the automatic double-sided copy component has a reversion path for reversing a front and a back of the sheet and includes a plurality of reversing rollers that form the reversion path.

9. The image processing apparatus according to claim 7, wherein
the automatic double-sided copy component is configured to reverse a front and a back of the sheet when an image is formed on both the front and back sides of the sheet.

10. The image processing apparatus according to claim 7, wherein
the torque generator is disposed in a vicinity of closer to a bearing of the roller than to an end portion of the roller opposite to the bearing.

11. The image processing apparatus according to claim 7, wherein
the torque generator is configured to adjust the torque.

12. The image processing apparatus according to claim 7, wherein
the clutch is an electromagnetic clutch.

13. The image processing apparatus according to claim 7, wherein
the torque generator is configured to apply a substantially constant torque to the roller during conveyance of the sheet.

14. The image processing apparatus according to claim 7, wherein the roller rotates around a shaft, and the torque generator is disposed on the shaft.

15. An automatic double-sided copy conveying device, comprising:

a roller configured to convey a sheet;

a motor configured to drive the roller;

a clutch configured to connect or disconnect a drive of the motor with respect to the roller;

a torque generator configured to apply a torque to the roller, wherein the torque generator comprises:

a sliding member that is slidable with respect to the roller, and a bias generator that biases the sliding member; and a driven roller configured to be separated from the roller in a sheet conveying direction and rotate according to a rotation of the roller, wherein a plurality of sliding members is provided in the torque generator, the plurality of sliding members comprises a first sliding member that is slidable with respect to the roller, and a second sliding member that is slidable with respect to the driven roller, and the bias generator bridges between the first sliding member and the second sliding member.

16. The automatic double-sided copy conveying device according to claim 15, wherein the torque generator is disposed closer to a bearing of the roller than to an end portion of the roller opposite to the bearing.

17. The automatic double-sided copy-conveying device according to claim 15, wherein the roller rotates around a shaft, and the torque generator is disposed on the shaft.

18. The automatic double-sided copy-conveying device according to claim 15, wherein the torque generator is configured to adjust the torque.

19. The automatic double-sided copy-conveying device according to claim 15, wherein the clutch is an electromagnetic clutch.

20. The automatic double-sided copy-conveying device according to claim 15, wherein the torque generator is configured to apply a substantially constant torque to the roller during conveyance of the sheet.

* * * * *